US011542585B2

(12) United States Patent
Izumi et al.

(10) Patent No.: US 11,542,585 B2
(45) Date of Patent: Jan. 3, 2023

(54) METHOD FOR TREATING INNER WALL SURFACE OF TREATMENT OBJECT

(71) Applicant: IWATANI CORPORATION, Osaka (JP)

(72) Inventors: Koichi Izumi, Amagasaki (JP); Masahiro Furutani, Amagasaki (JP); Tsuyoshi Yamamoto, Amagasaki (JP)

(73) Assignee: IWATANI CORPORATION, Osaka (JP)

( * ) Notice: Subject to any disclaimer, the term of this patent is extended or adjusted under 35 U.S.C. 154(b) by 374 days.

(21) Appl. No.: 16/652,982

(22) PCT Filed: Jul. 27, 2018

(86) PCT No.: PCT/JP2018/028178
§ 371 (c)(1),
(2) Date: Apr. 1, 2020

(87) PCT Pub. No.: WO2019/106880
PCT Pub. Date: Jun. 6, 2019

(65) Prior Publication Data

US 2020/0239995 A1 Jul. 30, 2020

(30) Foreign Application Priority Data

Nov. 30, 2017 (JP) ..... JP2017-230351

(51) Int. Cl.
*C23C 8/14* (2006.01)

(52) U.S. Cl.
CPC ..... *C23C 8/14* (2013.01)

(58) Field of Classification Search
CPC ..... C23C 8/12; C23C 8/14
See application file for complete search history.

(56) References Cited

FOREIGN PATENT DOCUMENTS

| | | | | |
|---|---|---|---|---|
| JP | H09-195031 | A | | 7/1997 |
| JP | 2003-201554 | A | | 7/2003 |
| JP | 2003201554 | A | * | 7/2003 |
| JP | 2009-084602 | A | | 4/2009 |
| JP | 2009084602 | A | * | 4/2009 |
| JP | 2011-140692 | A | | 7/2011 |
| JP | 2011140692 | A | * | 7/2011 |

OTHER PUBLICATIONS

International Search Report issued in PCT/JP2018/028178; dated Aug. 21, 2018.

* cited by examiner

*Primary Examiner* — Jenny R Wu
(74) *Attorney, Agent, or Firm* — Studebaker & Brackett PC

(57) ABSTRACT

A method for treating an inner wall surface of a treatment object uses a treatment object that is at least one of a container housing an ozone gas, a treatment container housing an object to be subjected to a surface treatment using an ozone gas and a pipe configured to supply an ozone gas. The method for treating an inner wall surface of a treatment object includes the steps of: determining whether an abnormal part is present in the inner wall surface of the treatment object or not; and distributing an ozone gas having a concentration of 10% by volume or more and 30% by volume or less and a temperature of 60° C. or less such that the ozone gas contacts the inner wall surface of the treatment object after the step of determining whether an abnormal part is present or not.

4 Claims, 3 Drawing Sheets

METHOD FOR TREATING INNER WALL SURFACE OF TREATMENT OBJECT

TECHNICAL FIELD

The present invention relates to a method for treating an inner wall surface of a treatment object. This application claims priority to Japanese Patent Application No. 2017-230351, which was filed on Nov. 30, 2017, and is incorporated herein by reference in its entirety.

BACKGROUND ART

There has been a method of supplying an ozone gas to a pipe or the like for supplying a gas to thereby passivate an inner wall surface of the pipe or the like (see, for example, Patent Literature 1). In the passivation method disclosed in Patent Literature 1, an ozone treatment unit is connected to a constructed pipe system, and an ozone gas is applied to the inner surface of the pipe system to passivate the inner surface of the pipe system. In this passivation method, an ozone gas having an ozone concentration of 10% by volume or less in an oxygen gas is applied for a predetermined time, and then, multiple types of ozone gases whose ozone concentrations are increased stepwise are sequentially applied each for a predetermined time.

CITATION LIST

Patent Literature

Patent Literature 1: Japanese Patent Application Laid-Open No. 2003-201554

SUMMARY OF INVENTION

Technical Problem

In the passivation method disclosed in Patent Literature 1, the passivation treatment is complicated because of the stepwise increase of the ozone concentration.

It is therefore an object to provide a method for treating an inner wall surface of a treatment object capable of efficiently treating the inner wall surface of the treatment object.

Solution to Problems

A method for treating an inner wall surface of a treatment object according to the present application uses a treatment object that is at least one of a container housing an ozone gas and having a metal inner wall, a treatment container containing an object to be subjected to a surface treatment using an ozone gas and having a metal inner wall, and a pipe configured to supply an ozone gas and having a metal inner wall. With this method, the inner wall surface of the treatment object is treated. The method for treating the inner wall surface of the treatment object includes the steps of: determining whether an abnormal part is present in the inner wall surface of the treatment object or not; and distributing an ozone gas having a concentration of 10% by volume or more and 30% by volume or less and a temperature of 60° C. or less such that the ozone gas contacts the inner wall surface of the treatment object after the step of determining whether the abnormal part is present or not.

Patent Literature 1 is intended to solve a problem in which mixture of a metal ion component in a material such as pure water, purified water, or another type of fluid affects other components (see paragraph [0006] in Patent Literature 1), and the passivation process described in Patent Literature 1 is conducted in order to maintain the concentration of a gas for a semiconductor with high accuracy (see paragraph [0004] in Patent Literature 1). Inventors of the present application found an application in which the treatment described above is not needed and it is sufficient to suppress a decrease in an ozone concentration without achieving reduction of the amount of a metal eluted by corrosion in performing a surface treatment on an object using an ozone gas with a treatment object. The inventors intensively studied in order to suppress a decrease in an ozone concentration without the passivation process described in Patent Literature 1, to obtain a configuration according to the present application.

In the method for treating an inner wall surface of a treatment object according to the present application, a pretreatment is first performed to determine whether an abnormal part occurs in the inner wall surface of the treatment object or not. The abnormal part herein refers to, for example, a part to which an organic substance such as oil or fat or a foreign substance such as a resin is attached to the inner wall surface of the treatment object or a damaged part in the inner wall surface of the treatment object. This pretreatment can suppress occurrence of abrupt heating in an abnormal part in performing a main treatment described later to thereby suppress damage on a pipe or the like.

Next, after the pretreatment, the main treatment is performed to distribute an ozone gas having a concentration of 10% by volume or more and 30% by volume or less and a temperature of 60° C. or less such that the ozone gas contacts the inner wall surface of the treatment object. This main treatment enables suppression of a decrease in the ozone concentration in performing a surface treatment on an object to be subjected to a surface treatment using the ozone gas in the treatment object.

The main treatment according to the present application is not intended to increase the ozone concentration stepwise as disclosed in Patent Literature 1 (see [Claim 2] of Patent Literature 1), and does not include a changing step of increasing the concentration of an ozone gas in the main treatment. Thus, the inner wall surface of the treatment object can be efficiently treated. In particular, in Patent Literature 1, the passivation process is performed by using an ozone gas having a high concentration of 40% by volume or 80% by volume, as described in paragraph [0019]. Such a high-concentration ozone gas is difficult for use in treatment. In the present application, however, an ozone gas having a concentration of 10% by volume or more and 30% by volume or less is used, and this ozone gas has a relatively low temperature of 60° C. or less. Thus, this ozone gas can be easily used for treatment.

For the foregoing reasons, in the method for treating the inner wall surface of the treatment object according to the present application, the inner wall surface of the treatment object can be efficiently treated.

In the method for treating the inner wall surface of the treatment object, in the step of distributing the ozone gas, the ozone gas having a temperature of room temperature or more may be distributed. The distribution of the ozone gas having such a temperature enables a more efficient treatment on the inner wall surface of the treatment object.

In the method for treating the inner wall surface of the treatment object described above, the step of distributing the ozone gas may be performed in a time range from 6 hours or more to 48 hours or less. This time range further ensures a treatment on the inner wall surface of the treatment object.

In the method for treating the inner wall surface of the treatment object, the step of determining whether an abnormal part is present in the inner wall surface of the treatment object or not, may include a sub-step of distributing an ozone gas having a concentration of 5% by volume or more and less than 10% by volume such that the ozone gas contacts the inner wall surface of the treatment object. In a case where an organic substance such as oil or fat or a foreign substance such as a resin is attached to the inner wall surface or a case where the inner wall surface is damaged, when the ozone gas is supplied, the temperature of the attached part or the damaged part of the inner wall surface increases due to oxidation heating. Thus, the distribution of the ozone gas having a concentration of 5% by volume or more and less than 10% by volume makes it possible to determine whether a temperature rise occurs in the treatment object or not. In this manner, it is possible to determine whether an abnormal part is present in the inner wall surface of the treatment object or not. In addition, the main treatment is continued so that a higher efficiency can be obtained.

In the method for treating the inner wall surface, the treatment object may include a first wall and a second wall opposite to the first wall, an inlet for supplying the ozone gas into the treatment object may be disposed near the first wall, and an outlet for discharging the ozone gas from the treatment object may be disposed near the second wall. This configuration of the treatment object allows the ozone gas to be distributed from the first wall toward the second wall while suppressing remaining of the ozone gas in the treatment object. In this manner, the inner wall surface of the treatment object can be uniformly treated.

The method for treating the inner wall surface may further include the step of switching the ozone gas to an oxygen gas or an ozone gas having a concentration of 5% by volume or more and less than 10% by volume and distributing the oxygen gas or the ozone gas, after the step of distributing the ozone gas having a concentration of 10% by volume or more and 30% by volume or less and a temperature of 60° C. or less is started, and the step of switching the ozone gas may be performed if it is determined whether a temperature rise occurs in at least a region of the treatment object or not in the step of determining whether a temperature rise occurs in at least a region of the treatment object or not. By performing this step of determining whether a temperature rise occurs or not, it is possible to determine whether abnormal heating occurs in the treatment object or not. In addition, the ozone gas is switched to an ozone gas having a concentration of 5% by volume or more and less than 10% by volume or an oxygen gas so that a temperature rise in the treatment object can be suppressed.

Effects of the Invention

With the method for treating the inner wall surface of the treatment object described above, it is possible to provide a method for treating an inner wall surface of a treatment object capable of efficiently treating an inner wall surface of a treatment object.

DESCRIPTION OF EMBODIMENTS

Figure 1:
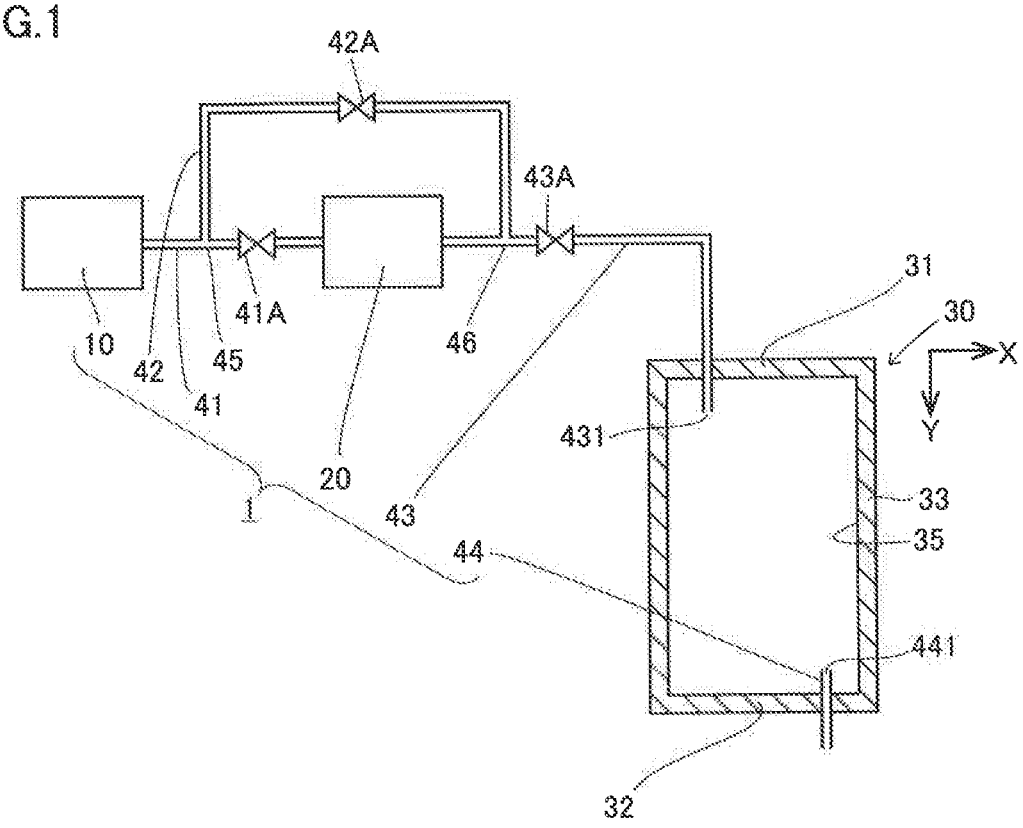
FIG. 1 is a schematic view illustrating an example of a treatment device.

One embodiment of a method for treating an inner wall surface of a treatment object according to the present application will be described with reference to the drawings. In the following drawings, the same or corresponding parts are denoted by the same reference numerals, and the description thereof will not be repeated.

First, a treatment device for use in the method for treating an inner wall surface of a treatment object according to the present application will be described. FIG. 1 is a schematic view illustrating an example of a treatment device. With reference to FIG. 1, a treatment device 1 is used for treating an inner wall surface 35 of a treatment container 30 as a treatment object. The treatment container 30 houses an object to be subjected to a surface treatment using an ozone gas. The treatment container 30 is, for example, a chamber in which a semiconductor wafer is placed so that the surface thereof is cleaned. In the treatment container 30 illustrated in FIG. 1, the direction from an upper wall to a lower wall described later will be referred to as a Y-axis direction, and a direction perpendicular to the Y-axis direction will be referred to as an X-axis direction. The treatment device 1 includes an ozone generator 10, an ozone gas condenser 20, and pipes 41, 42, 43, and 44.

The ozone generator 10 is, for example, an ozonizer. The ozone generator 10 generates an ozone gas having a predetermined ozone concentration. The generated ozone gas is a gas mixture including ozone and oxygen. In this embodiment, the ozone generator 10 generates a first ozone gas having an ozone concentration of 5% by volume or more and less than 10% by volume. The ozone concentration of the first ozone gas is preferably 5% by volume or more and 8% by volume or less, and more preferably 5% by volume or more and 6% by volume or less.

The ozone gas condenser 20 condenses the ozone concentration of the first ozone gas generated by the ozone generator 10, and generates an ozone gas having an ozone concentration higher than the ozone concentration of the first ozone gas. As the ozone gas condenser 20, an ozone gas condenser 20 including an adsorbent may be used, for example. In this embodiment, the ozone gas condenser 20 generates a second ozone gas having an ozone concentration of 10% by volume or more and 30% by volume or less. The ozone concentration of the second ozone gas is preferably 15% by volume or more and 30% by volume or less, and more preferably 20% by volume or more and 28% by volume or less.

The pipe 41 is disposed between the ozone generator 10 and the ozone gas condenser 20. The pipe 41 is provided with a shut-off valve 41A for opening and closing a channel of the pipe 41. The pipe 43 is disposed between the ozone gas condenser 20 and the treatment container 30. The pipe 43 is provided with a shut-off valve 43A for opening and closing a channel of the pipe 43. The pipe 41 is branched to the pipe 42 at a branch point 45 located between the ozone generator 10 and the shut-off valve 41A. The pipe 42 is connected to the pipe 43 at a branch point 46 located between the ozone gas condenser 20 and the shut-off valve 43A. The pipe 42 is provided with a shut-off valve 42A for opening and closing a channel of the pipe 42. When the shut-off valves 41A and 43A are opened and the shut-off valve 42A is closed, a gas is thereby supplied from the ozone generator 10 to the treatment container 30 by way of the ozone gas condenser 20. When the shut-off valves 42A and 43A are opened and the shut-off valve 41A is closed, a gas is thereby supplied from the ozone generator 10 to the treatment container 30 without passing through the ozone gas condenser 20. Each of the pipes 41, 42, and 43 is made of a metal, such as stainless steel or aluminium.

The treatment container 30 includes a cylindrical side wall 33, an upper wall 31 covering one opening of the side wall 33 and serving as a first wall, and a lower wall 32 covering the other opening of the side wall 33 and serving as a second wall. The upper wall 31 and the lower wall 32 opposite to each other with an interval in the Y-axis direction. Each of the side wall 33, the upper wall 31, and the lower wall 32 is made of a metal, such as stainless steel or aluminium.

The pipe 43 is disposed such that the upper wall 31 is partially opened and an inlet 431 is disposed in the treatment container 30. The inlet 431 is disposed near the upper wall 31 and closer to the side wall 33 than the center of the upper wall 31. The pipe 44 is disposed such that the lower wall 32 is partially opened and an outlet 441 is disposed in the treatment container 30. The outlet 441 is disposed near the lower wall 32 and closer to the side wall 33 than the center of the lower wall 32. The inlet 431 and the outlet 441 are disposed at different locations in the X-axis direction. In the manner described above, a gas supplied into the treatment container 30 flows from the upper wall 31 toward the lower wall 32 (mainly in the direction of the arrow indicating the Y-axis direction in FIG. 1). Through the pipe 44, the gas is discharged from the treatment container 30. The pipe 44 is made of a metal, such as a stainless steel or aluminium.

Figure 2:
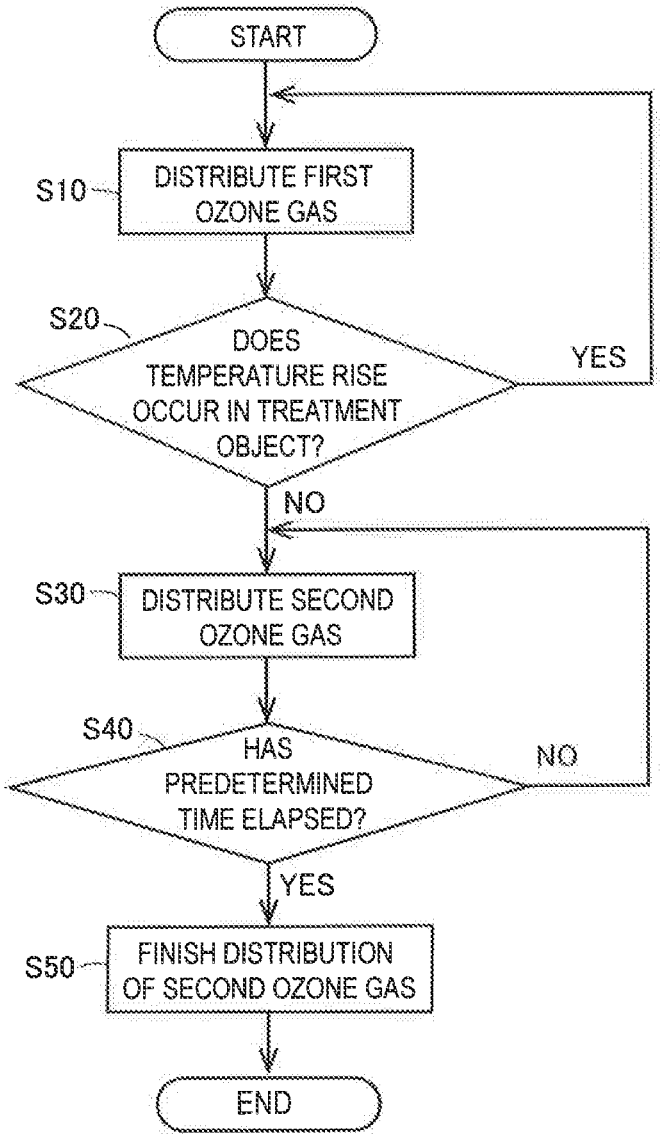
FIG. 2 is a flowchart depicting a method for treating an inner wall surface of a treatment object.

Next, a procedure for treating the treatment container 30 with the method for treating an inner wall surface of a treatment object according to this embodiment will be described. FIG. 2 is a flow chart depicting a method for treating an inner wall surface of the treatment object.

With reference to FIG. 1, in the method for treating an inner wall surface of a treatment object according to this embodiment, first, the step of determining whether an abnormal part is present in the inner wall surface of the treatment object or not is performed as a step (S10). More specifically, the step of distributing a first ozone gas in a predetermined time is performed. In this state, the shut-off valve 42A and the shut-off valve 43A are open, and the shut-off valve 41A is closed. Consequently, the first ozone gas generated by the ozone generator 10 is supplied into the treatment container 30 through the pipe 41, the pipe 42, and the pipe 43. Then, the first ozone gas is discharged from the treatment container 30 through the pipe 44. In this manner, the first ozone gas is distributed in the treatment container 30. The first ozone gas is distributed at, for example, 60° C. or less. The lower limit of the temperature of the first ozone gas is a room temperature. The room temperature here is a temperature of about 10° C. to about 30° C., and is 23° C., for example.

Subsequently, as a step (S20), the step of determining whether a temperature occurs in at least a region of the treatment object or not is performed. More specifically, it is determined whether a temperature rise occurs in a region of the treatment container 30 or not. The determination whether the temperature rise occurs or not is performed by determining whether or not a region of the treatment container 30 is at a predetermined temperature or more, for example. The predetermined temperature is, for example, 40° C. It may be determined whether the temperature rise occurs or not by touching a region of the treatment container 30.

In the step (S20), if the temperature rise does not occur in at least a region of the treatment object (NO in S20), the step of distributing the first ozone gas is finished. More specifically, the shut-off valve 42A is closed. Thereafter, as a step (S30), the step of distributing the second ozone gas in a predetermined time is performed. More specifically, the shut-off valve 41A and the shut-off valve 43A are opened, and the shut-off valve 42A is closed. Consequently, the first ozone gas generated by the ozone generator 10 is condensed by the ozone gas condenser 20, and a second ozone gas is generated. The second ozone gas is supplied into the treatment container 30 through the pipe 43. The second ozone gas is discharged from the treatment container 30. In this manner, the second ozone gas is distributed in the treatment container 30, and the inner wall surface 35 of the treatment container 30 is treated. The second ozone gas is distributed at 60° C. or less. The lower limit of the temperature of the second ozone gas is a room temperature. The room temperature here is a temperature of about 10° C. to about 30° C., and is 23° C., for example. The temperature of the second ozone gas is preferably 23° C. or more and 30° C. or less.

Thereafter, as a step (S40), it is determined weather a predetermined time has elapsed or not. The predetermined time is 6 hours or more and 48 hours or less. The predetermined time is preferably 6 hours or more and 24 hours or less, and is more preferably 6 hours or more and 12 hours or less. When the predetermined time has elapsed (YES in S40), the step of distributing the second ozone gas is finished (S50). More specifically, the shut-off valve 41A and the shut-off valve 43A are closed.

In the method for treating an inner wall surface of a treatment object according to this embodiment, first, a pretreatment is performed to determine whether an abnormal part is present in the inner wall surface of the treatment container 30 or not. The abnormal part herein refers to, for example, a part to which an organic substance such as oil or fat or a foreign substance such as a resin is attached to the inner wall surface 35 of the treatment container 30 or a damaged part in the inner wall surface of the treatment object 30. This pretreatment can suppress occurrence of abrupt heating in the abnormal part in performing a main treatment described later to thereby suppress damage on the pipe or the like. After the pretreatment, the main treatment of distributing a second ozone gas is performed. In performing a surface treatment on an object to be subjected to the surface treatment using an ozone gas in the treatment container 30, the main treatment performed in the manner described above can suppress a decrease in the ozone concentration.

From the foregoing description, with the method of treating an inner wall or a treatment object according to this embodiment, the inner wall surface of the treatment object can be efficiently treated.

Such a treatment method is expected to have the following advantages. A thin film such as a natural oxide film is generally formed on an untreated inner wall surface 35 of the treatment container 30. Such a thin film contains minute damage in some cases, and the treatment of this embodiment can compensate for this minute damage. Accordingly, an ozone loss in an ozone gas generated with respect to the minute damaged part is suppressed, and as a result, this suppression is expected to contribute to suppression of a decrease in the ozone concentration of an ozone gas supplied to the treatment object.

In the embodiment, in the step of distributing the second ozone gas, the second ozone gas having a temperature greater than or equal to the room temperature is distributed. The distribution of the ozone gas having such a temperature enables a more efficient treatment of the inner wall surface 35 of the treatment container 30.

In the embodiment, the step of distributing the second ozone gas is performed in a time range from 6 hours or more and 48 hours or less. This time range further enables the treatment of the inner wall surface 35 of the treatment container 30.

In the embodiment, as the step of determining whether an abnormal part is present in the inner wall surface of the treatment object or not, the step (S10) of distributing the first ozone gas such that the first ozone gas contacts the inner wall surface 35 of the treatment container 30 is performed. In a case where an organic substance such as oil or fat or a foreign substance such as a resin is attached to the inner wall surface 35 or a case where the inner wall surface 35 is damaged, when the ozone gas is supplied, the temperature of the attached part or the damaged part of the inner wall surface 35 increases due to oxidation heating. In view of this, by distributing the first ozone gas, it is possible to determine whether a temperature rise occurs in the treatment container 30 or not. In this manner, it is possible to determine whether an abnormal part is present in the inner wall surface 35 of the treatment container 30 or not. In addition, the main treatment is continued so that a higher efficiency can be obtained.

In the embodiment, as the step of determining whether an abnormal part is present in the inner wall surface of the treatment object or not, the step (S20) of determining whether a temperature rise occurs in at least a region of the treatment container 30 or not is performed after the step of distributing the first ozone gas is started. By determining whether a temperature rise occurs or not in the manner described above, it is possible to determine whether an abnormal part is present in the inner wall surface 35 of the treatment container 30 or not.

In the embodiment, the treatment container 30 includes the upper wall 31 and the lower wall 32. The inlet 431 for supplying an ozone gas into the treatment container 30 is disposed near the upper wall 31. The outlet 441 for discharging an ozone gas from the treatment container 30 is disposed near the lower wall 32. This configuration of the treatment container 30 allows the ozone gas to be distributed from the upper wall 31 toward the lower wall 32 while suppressing remaining of the ozone gas in the treatment container 30. In this manner, the inner wall surface 35 of the treatment container 30 can be uniformly treated.

In the step (S20), if a temperature rise occurs in at least a region of the treatment container 30 (YES in S20), the step of distributing the first ozone gas is performed again (S10). This distribution of the first ozone gas can suppress the temperature rise in the treatment container 30.

In the step (S40), if the predetermined time has not elapsed (NO in S40), the step of distributing the second ozone gas is performed again (S30).

After starting the step of distributing the second ozone gas (S30), the step of determining whether a temperature rise occurs in at least a region of the treatment object or not may be performed. In addition, if it is determined that a temperature rise occurs in at least a region of the treatment object, the step of switching the gas to the first ozone gas and distributing the first ozone gas may be performed. By performing the step of determining whether a temperature rise occurs or not in the manner described above, it is possible to determine whether abnormal heating occurs in the treatment object or not. By switching the gas to the first ozone gas, a temperature rise in the treatment object can be suppressed. If a temperature rise occurs in at least a region of the treatment object, the gas may be switched to an oxygen gas so that the oxygen gas is distributed in a predetermined time and the step of distributing the first ozone gas is then performed. In this case, a temperature rise in the treatment object can also be suppressed.

In the embodiment, the pipe 44 is configured such that the lower wall 32 is partially opened and the inlet 431 is disposed in the treatment container 30. The present application, however, is not limited to this configuration. The pipe 44 may be configured such that the upper wall 31 is partially opened and the outlet 441 is disposed in the treatment container 30. In the manner similar to the embodiment, the outlet 441 is disposed near the lower wall 32 and closer to the side wall 33 than the center of the lower wall 32. This configuration also allows the ozone gas to be distributed from the upper wall 31 toward the lower wall 32.

In the embodiment, the treatment container 30 is the treatment object. The present application is, however, not limited to this example. The treatment object may be a container for housing an ozone gas, instead of the treatment container 30. A pipe for supplying an ozone gas may be a treatment object, instead of the treatment container 30. More specifically, this pipe is the pipes 43 and 44 in FIG. 1. The inner wall of each of the container and the pipe is made of a metal, such as stainless steel or aluminium.

In the embodiment, the step (S20) is performed after the step (S10). The present application is, however, not limited to this example, and the step (S30) may be performed after the step (S10). In the embodiment, the step (S40) is performed after the step (S30). The present application is, however, not limited to this example, and the step (S50) may be performed after the step (S30).

Figure 3:
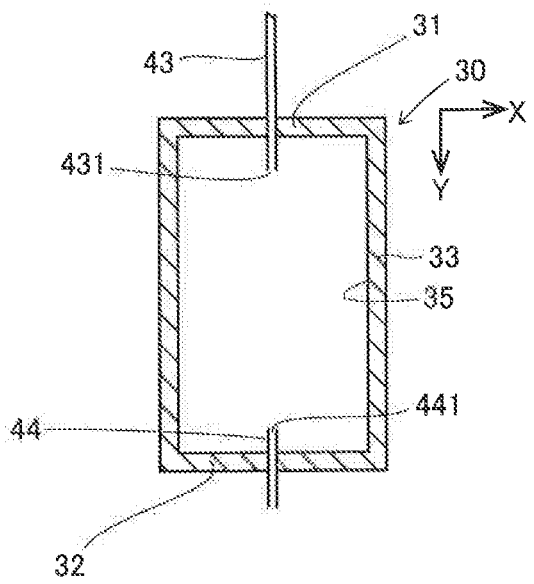
FIG. 3 is a schematic view illustrating a first variation of the treatment device.

Next, a variation of the embodiment will be described. FIG. 3 is a schematic view illustrating a first variation of the treatment device 1 for use in the method for treating an inner wall surface of a treatment object according to the embodiment. FIG. 3 shows only the pipes 43 and 44 and the treatment container 30 for easy understanding. With reference to FIG. 3, the pipe 43 is disposed such that a center region of the upper wall 31 is opened and the inlet 431 is disposed in the treatment container 30. The inlet 431 is disposed near the upper wall 31 and at the center of the upper wall 31. The pipe 44 is disposed such that a center region of the lower wall 32 is opened and the outlet 441 is disposed in the treatment container 30. The outlet 441 is disposed near the lower wall 32 and at the center of the lower wall 32. The inlet 431 and the outlet 441 are disposed at the same location in the X-axis direction. This configuration can also suppress remaining of an ozone gas in the treatment container 30 and enables the inner wall surface 35 of the treatment container 30 to be uniformly treated. The configuration of the treatment container 30 may be appropriately selected depending on, for example, the shape of an object to be housed in the treatment container 30 and subjected to a surface treatment and/or the flow rate of a gas supplied to the treatment container 30.

EXAMPLES

A vessel of stainless steel treated by the method for treating an inner wall surface of a treatment object according to the present application was prepared, and an evaluation was performed to determine an attenuation factor of an ozone concentration. A procedure of this evaluation is as follows.

The device illustrated in FIG. 1 was prepared, and as a treatment object, a vessel of stainless steel (SUS316L)

whose inner wall surface is subjected to electropolishing and mirror finishing was prepared. As a first ozone gas, an ozone gas having a temperature of 23° C. and a concentration of 5% by volume was distributed for two hours. Vessels in which an ozone gas having a temperature of 23° C. and a concentration of 23% by volume was distributed as a second ozone gas for 6 hours, 12 hours, and 24 hours, were prepared. For comparison, a vessel subjected to no treatment was also prepared. An attenuation factor of an ozone concentration in each of the vessels subjected to the treatment and the vessel subjected to no treatment was evaluated by the following method. More specifically, an ozone gas having an ozone concentration of 23% by volume was enclosed in each of the vessels, and the attenuation factor of the ozone concentration with time was evaluated. Ozone concentrations after 3 hours and 48 hours were measured, and an attenuation factor was calculated using 23% by volume as an initial value. Table 1 shows the result. In Table 1, the horizontal items indicate treatment times (untreated, 6 hours, 12 hours, and 24 hours), and the vertical items indicate leaving times (3 hours and 48 hours), and attenuation factors corresponding to these items are shown.

TABLE 1

| Evaluation Item | | Treatment time | | | |
|---|---|---|---|---|---|
| Attenuation factor (%) | | Untreated | 6 hours | 12 hours | 24 hours |
| Leaving time | 3 hours | 66% | 4% | 2% | 2% |
| | 48 hours | 100% | 10% | 8% | 5% |

As shown in the evaluation result in Table 1, in the untreated vessel, the ozone concentration was attenuated by 66% after 3 hours, and ozone was completely distinguished after 48 hours. On the other hand, in the vessel in which the treatment time of distribution of the second ozone gas was 6 hours, the ozone concentration was attenuated by 4% after 3 hours, and as compared to the untreated vessel, the attenuation factor decreased. In the vessel in which the treatment time was 6 hours, the attenuation of the ozone concentration was kept at 10% even after 48 hours, and the decrease in the ozone concentration was suppressed. In the vessels in which the treatment time of distribution of the second ozone gas was 12 hours or 24 hours, the ozone concentration decreased only by 2% after 3 hours, and the attenuation factor further decreased. For the foregoing result, the treatment of distribution of the second ozone gas for 6 hours or more can suppress a decrease in the ozone concentration. As described above, the method for treating the inner wall surface of the treatment object according to the present application can suppress a decrease in the ozone concentration.

It should be understood that the embodiment disclosed here is illustrative and non-restrictive in every respect. The scope of the present invention is defined by the terms of the claims, rather than the description above, and is intended to include any modifications within the scope and meaning equivalent to the terms of the claims.

INDUSTRIAL APPLICABILITY

The method for treating an inner wall surface of a treatment object according to the present application is especially advantageously applied to a treatment method requiring an efficient treatment of an inner wall surface of a treatment object.

DESCRIPTION OF REFERENCE NUMERALS

1: treatment device, 10: ozone generator, 20: ozone gas condenser, 30: treatment container, 31: upper wall, 32: lower wall, 33: side wall, 35: inner wall surface, 41, 42, 43, 44: pipe, 45, 46: branch point, 41A, 42A, 43A: shut-off valve, 431: inlet, 441: outlet.

The invention claimed is:

1. A method for treating an inner wall surface of a treatment object, the treatment object being at least one selected from the group consisting of a container housing an ozone gas and having a metal inner wall, a treatment container housing an object to be subjected to a surface treatment using the ozone gas and having a metal inner wall, and a pipe configured to supply the ozone gas and having a metal inner wall, the method comprising the steps of:

determining whether an abnormal part is present in the inner wall surface of the treatment object or not, including a sub-step of distributing an ozone gas having a concentration of 5% by volume or more and less than 10% by volume such that the ozone gas contacts the inner wall surface of the treatment object; and distributing an ozone gas having a concentration of 10% by volume or more and 30% by volume or less and a temperature of 60° C. or less such that the ozone gas contacts the inner wall surface of the treatment object, after the step of determining whether an abnormal part is present or not;

wherein the step of distributing the ozone gas is performed in a time range from 6 hours or more to 48 hours or less.

2. The method according to claim 1, wherein in the step of distributing the ozone gas, the ozone gas having a temperature of a room temperature or more is distributed.

3. The method according to claim 1, wherein the treatment object includes a first wall and a second wall opposite to the first wall, an inlet for supplying the ozone gas into the treatment object is disposed near the first wall, and an outlet for discharging the ozone gas from the treatment object is disposed near the second wall.

4. The method according to claim 1, further comprising a step of determining whether a temperature rise occurs in at least a region of the treatment object or not after start of the step of distributing the ozone gas having a concentration of 10% by volume or more and 30% by volume or less and a temperature of 60° C. or less; and a step of switching the ozone gas to an oxygen gas or an ozone gas having a concentration of 5% by volume or more and less than 10% by volume and distributing the oxygen gas or the ozone gas, wherein the step of switching the ozone gas is only performed when the temperature rise does not occur.

* * * * *